United States Patent [19]

Arnold

[11] 4,167,192

[45] Sep. 11, 1979

[54] CIRCULAR BRUSH

[75] Inventor: Franz Arnold, Triengen, Switzerland

[73] Assignee: Trisa Bürstenfabrik AG Triengen, Triengen, Switzerland

[21] Appl. No.: 824,922

[22] Filed: Aug. 15, 1977

[51] Int. Cl.[2] ..... A45D 20/00

[52] U.S. Cl. ..... 132/9; 15/206; 34/97; 132/33 R

[58] Field of Search ..... 15/16 D, 206, 186–188, 15/159, 159 A, 402, DIG. 5; 132/9, 11, 85, 120; 34/96, 98, 97

[56] References Cited

U.S. PATENT DOCUMENTS

| | | | |
|---|---|---|---|
| 2,630,127 | 3/1953 | Isbell | 132/40 |
| 3,322,144 | 5/1967 | Boer, Jr. et al. | 34/98 X |
| 3,355,759 | 12/1967 | Sloan | 15/160 X |
| 4,023,578 | 5/1977 | Buhler | 132/9 |
| 4,076,032 | 2/1978 | Misercola | 132/9 |

FOREIGN PATENT DOCUMENTS

| | | | |
|---|---|---|---|
| 72357 | 4/1970 | Fed. Rep. of Germany | 132/85 |
| 2604543 | 8/1977 | Fed. Rep. of Germany | 132/85 |
| 1408096 | 6/1965 | France | 132/9 |
| 607951 | 9/1960 | Italy | 132/9 |

*Primary Examiner*—Peter Feldman

*Attorney, Agent, or Firm*—Werner W. Kleeman

[57] ABSTRACT

A circular brush having two mutually intertwined wire sections serving as a bristle carrier, wherein the bristles of the brush are fixedly clamped between the intertwined wire sections in a helical- or spiral-like manner. A tubular element coaxially surrounds the wire sections. This tubular element is provided with openings at its jacket surface or shell and through such openings there extend towards the outside the ends of the bristles.

11 Claims, 2 Drawing Figures

CIRCULAR BRUSH

BACKGROUND OF THE INVENTION

The present invention relates to a new and improved construction of a circular brush of the type possessing two mutually intertwined wire sections serving as a bristle carrier or support, wherein the bristles are fixedly clamped in a helical- or spiral-like fashion between the wire sections.

A circular brush of the previously mentioned type can be fabricated more economically than one where the bristles must be inserted in a number of rows of bores in a bristle carrier or support. What is however disadvantageous with the previously mentioned brush is that the bristles which are fixedly clamped only at the direct region of the brush axis exhibit less support at the bristle ends with increasing diameter of the brush, so that when the brush is used and the bristles are subjected to loads or forces these bristles tend to bend away more easily. Depending upon the use and hardness of the bristles it is therefore not possible to manufacture such circular brush with a random or optionally selected diameter if it is intended to satisfactorily fulfull its function. However, on the other hand, with many fields of use of such type brush there is required a certain minimum diameter.

Hence, for instance, there is known to the art a hair brush of the previously mentioned type, wherein the strength of the bristles is not adequate in all respects due to the relatively large length of such bristles, since the bristles tend to bend out beyond a desired degree when the hair of the user is strongly brushed with such hair brush. Furthermore, such type brush is afflicted with the drawback that the hairs of the user, during curling or turning-in the hairs,—and for which purpose such circular brush is primarily provided—tend to wind about the intertwined wires. However, the thus resulting winding diameter is much too small for the contemplated purpose and additionally can lead to clamping of the hairs in the brush.

SUMMARY OF THE INVENTION

Hence, with the foregoing in mind it is a primary object of the present invention to provide a new and improved construction of circular brush of the previously mentioned type which is not associated with the aforementioned drawbacks and limitations of the prior art constructions.

Still another significant object of the present invention aims at the provision of a new and improved construction of circular brush which is relatively simple in design, economical to manufacture, and easy to use.

Yet a further object of the present invention aims at a new and improved construction of circular brush incorporating means for positively securing the bristles thereto in a manner protecting such bristles against bending through in an undesired degree when used.

Now in order to implement these and still further objects of the invention, which will become more readily apparent as the description proceeds, the circular brush of this development is manifested by the features that there is provided a tubular element or member which coaxially surrounds the wire sections. This tubular element possesses openings in its jacket surface or shell, and the ends of the bristles extend outwardly through such openings.

By virtue of the inventive arrangement it is possible to manufacture a circular brush on a relatively economical basis, and the core diameter corresponding to the tubular element can be randomly selected. The free ends of the bristles which are guided outwardly through the tubular element therefore still possess adequate strength even in the case of greater diameter of the brush. Such circular brush therefore can be ideally accommodated to the requirements of a hair brush.

According to a preferred constructional manifestation of the invention the openings in the jacket surface or outer wall of the tubular element can be in the form of holes of a perforation arrangement, the perforation arrangement being formd by rows of holes, the holes of which in each case are off-set with respect to one another. Due to this construction it is possible, for instance, to accommodate the spacing of the holes to the bristle density. There also exists the possibility of appropriately accommodating the rows of holes to the helical or spiral configuration of the bristle ends. Furthermore, the bristles are positively guided in the holes, however not rigidly guided, thereby retaining a certain elasticity of the bristles, notwithstanding the possible use of short bristles.

The tubular element or member can be formed of metal, preferably of rustproof steel. Due to this construction the bristle carrier or support possessing the tubular element is heat-resistant so that such type brush, also when used in conjunction with a hot air blower or dryer, does not exhibit any disadvantageous effects for the bristle carrier.

In accordance with a further preferred construction the tubular element can be attached in a simple manner if it is connected at its one end with a rod- or shaft-like hand grip or handling portion arranged coaxially with respect to the tubular element. In this hand grip there are anchored the intertwined wires and the other end of the tubular element may be closed with an end piece or member at which there is retained the other end of the intertwined wires.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
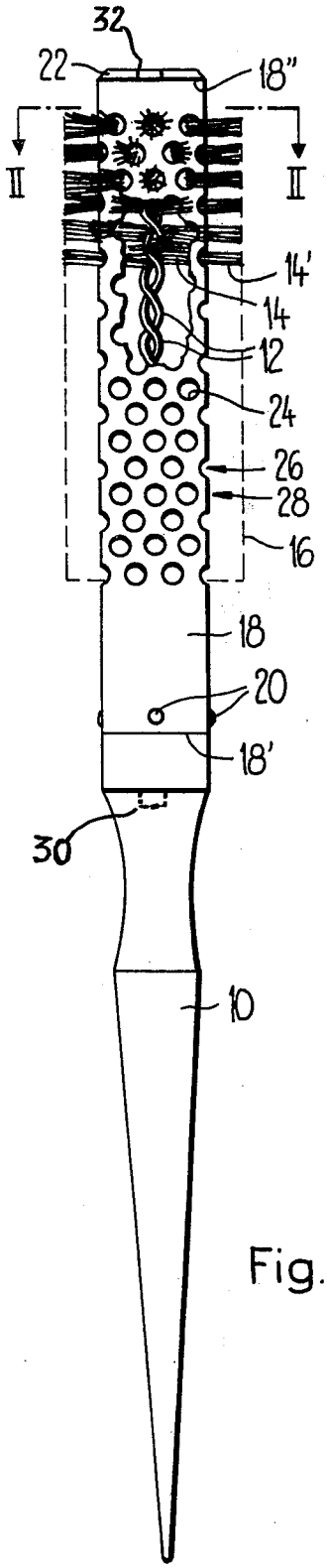
FIG. 1 is a side view of a circular brush constructed according to the present invention and showing partially broken-away the tubular element.

Describing now the drawings, the circular brush illustrated in FIG. 1 will be seen to comprise a rod or shaft-shaped handle or hand-grip 10 defining a handling portion in which there are anchored in any convenient fashion, for instance by providing a hole or socket in the handle 10, as generally indicated by reference character 30, the ends of two mutually intertwined wire sections or members 12. Bristles 14 are fixedly clamped between the intertwined wire sections 12 in a helical- or spiral-like manner. To improve clarity in illustration, the bristles 14 have only been shown in the illustration of FIG. 1 as extending over a partial region of the brush, although it is to be understood that as concerns the completely fabricated circular brush these bristles 14 extend over the entire length of the region indicated by the broken lines 16.

The intertwined wire sections 12 are coaxially surrounded by a tubular element or member 18 which is attached at the region of its one end 18' by means of the attachment or securing elements 20 with the handle or hand grip 10. At the other end 18'' of the tubular element or member 18 there is inserted an end piece 22 serving as a closure element. This end piece 22 also can be provided with a hole or bore 32 for receiving the other ends of the intertwined wire sections 12 so that these wire sections 12 are coaxially supported with respect to the tubular element 18.

At the region 16 of the bristles 14 the tubular element 18 is equipped with a perforation arrangement comprising holes or bores 24 which are distributed over the periphery of such tubular element. Extending outwardly through these holes 24 are the ends 14' of the bristles 14. The diameter of the holes 24 is however dimensioned such that the total cross-section of the bristles extending through a single hole only fills a fraction of the hole cross-section. Consequently, the ends 14' of the bristles 14 which are already anchored between the mutually intertwined wire sections 12 can be introduced into the holes 24 without mutually hindering one another. The perforation arrangement comprises rows 26, 28 of such holes 24, with the holes of mutually neighboring hole rows being arranged in mutually offset relationship to one another.

It is also conceivable to arrange in the tubular element 18, instead of the holes 24, parallel slots which extend from the end 18'' of the tubular element 18 over the bristle region 16. With this arrangement the bristles then would be subdivided into longitudinal rows. It is here also mentioned that between the tubular element 18 and the intertwined wire sections 12 there is present a radial spacing.

The tubular element 18 preferably consists of metal, especially a rustproof steel. However, it is also conceivable to fabricate the tubular element of a different material, for instance a suitable plastic. Selection of the material from which the tubular element is formed is not crucial, particularly since many suitable materials are available for the intended purpose.

Figure 2:
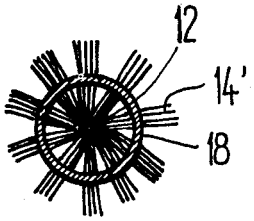
FIG. 2 is a cross-sectional view of the arrangement of FIG. 1, taken substantially along the lines II—II thereof.

Attention is now directed to FIG. 2 illustrating a cross-sectional view of the arrangement of FIG. 1, taken substantially along the line II—II thereof. From this Figure there will be apparent that the bristles 14 together with their ends 14' are arranged in bunches distributed uniformly over the periphery of the tubular element 18. In order to improve clarity in illustration there have only been shown in FIG. 2 the bristles 14 which extend through the upper row of holes 24.

The brush of this invention therefore combines the advantages of the simple bristle anchoring by means of the intertwined wire sections or pieces 12 with the advantages of a brush of larger core diameter. The core diameter in this case corresponds to the diameter of the tubular element 18. Due to the freedom of play of the bristles 14 in the holes or bores 24, these bristles are bent to a lesser degree when subjected to load than is the case where the bristles are fixedly anchored in a conventional bristle carrier or support, so that there is a lesser danger of rupture of such bristles.

While there are shown and described present preferred embodiments of the invention, it is to be distinctly understood that the invention is not limited thereto, but may be otherwise variously embodied and practiced within the scope of the following claims.

What I claim is:

1. A light-weight circular hairbrush for use with a separate hot air blower, comprising:

a bristle carrier composed of two mutually intertwined wire sections;

bristles fixedly clamped in a substantially helical-like arrangement between the intertwined wire sections;

a tubular element coaxially surrounding the intertwined wire sections;

said tubular element having a jacket surface provided at its circumference with openings therethrough;

said bristles having free ends extending outwardly through said openings;

a handling portion fixedly attached to the tubular element for solely handling the circular hairbrush;

said handling portion being devoid of any air flow communication with the interior of said tubular element;

said tubular element being formed of metal;

said tubular element having opposed ends;

means for connecting said handling portion substantially coaxially with respect to said tubular element;

said handling portion include means for anchoring one end region of the intertwined wire sections;

an end piece means for closing the other opposed end of the tubular element;

said end piece means includes means for retaining the other end region of the intertwined wire sections; and said tubular element has a portion coextending onto said handling portion.

2. A circular brush as defined in claim 1, wherein:

said handling portion having a free end and serving for manipulating the brush;

said handling portion being provided with a part devoid of bristles capable of receiving the thumb and index finger of the user for providing a bearing means for rotation of the brush during hairstyling;

said handling portion including a region spaced from said bearing means and which is structured to engage with the middle finger of the hand of the user to lock the brush against any undesired axial movement;

the remaining part of the handling portion which extends from the said structural region in the direction of its free end being capable of engaging with the remaining fingers, whereby the structured region in conjunction with said remaining part prevents undesired canting of the brush.

3. The circular brush as defined in claim 2, wherein:

said coextending portion of the tubular element is integrated with said bearing means of the handling portion.

4. The circular brush as defined in claim 2, wherein:

said part devoid of bristles constituting said bearing means comprises an extension of said tubular element.

5. The circular brush as defined in claim 4, wherein:

said extension of said tubular element has essentially the same diameter as said tubular element and is integral therewith.

6. The circular brush as defined in claim 2, wherein:

said structured region constitutes a depression having an inwardly recessed part bounded at opposite ends by arched portions.

7. The circular brush as defined in claim 6, wherein:

said arched portions provide an axial lock for the brush in both directions of the lengthwise extent thereof.

8. The light-weight circular brush as defined in claim 1, wherein:

said handling portion is a solid body.

9. A light-weight circular brush as defined in claim 1:

said openings permitting cross-flow of air from the separate hot air blower whereby hot air effluxing from the separate hot air blower can impinge with hair curled about said brush at a side of the tubular element remote from the scalp, the air cross-flowing through the interior of the tubular element at a lower temperature and effluxing from openings at the opposite side of the tubular element confronting the scalp, whereby curling of the hair is enhanced while ensuring that due to the cross-flow effect only air at a lower temperature comes into contact with the scalp so as to protect against air at too great temperature reaching the scalp.

10. The light-weight circular brush as defined in claim 1, wherein:

said handling portion has an inwardly recessed part bounded by arched portions.

11. The light-weight circular brush as defined in claim 1, wherein:

said metal is rustproof steel.

* * * * *